US006113404A

United States Patent [19]

Choy

[11] Patent Number: 6,113,404

[45] Date of Patent: Sep. 5, 2000

[54] RESILIENT EJECTOR FOR CARD EDGE CONNECTOR AND CARD EDGE CONNECTOR HAVING THE SAME

[75] Inventor: Edmond Choy, Union City, Calif.

[73] Assignee: Hon Hai Precision Ind. Co., Ltd., Taipei Hsien, Taiwan

[21] Appl. No.: 09/301,683

[22] Filed: Apr. 28, 1999

[51] Int. Cl.[7] ..... H01R 13/62

[52] U.S. Cl. ..... 439/160

[58] Field of Search ..... 439/160, 157, 439/152, 155

[56] References Cited

U.S. PATENT DOCUMENTS

| | | | |
|---|---|---|---|
| 5,470,242 | 11/1995 | Cheng et al. | 439/157 |
| 5,672,069 | 9/1997 | Cheng et al. | 439/160 |
| 5,746,614 | 5/1998 | Cheng et al. | 439/157 |

*Primary Examiner*—Lincoln Donovan
*Assistant Examiner*—Javaid Nasri
*Attorney, Agent, or Firm*—Wei Te Chung

[57] ABSTRACT

An ejector for an electrical connector is disclosed. The connector includes an elongate housing receiving and retaining conductive contacts therein and two end blocks formed on opposite ends of the housing. Each end block has two spaced guide walls. The ejector includes a body received between the guide walls. Two slits are defined in the body of the ejector thereby forming two outside walls and an internal wall between the outside walls. Each outside wall forms a projection for releasably engaging with a recess defined in the corresponding guide wall of the end block. The slits provide the outside walls with resiliency for facilitating engagement between the projections thereof and the recesses of the corresponding guide walls while the internal wall provides the ejector with rigidity during engagement between the projections and the recesses.

4 Claims, 4 Drawing Sheets

RESILIENT EJECTOR FOR CARD EDGE CONNECTOR AND CARD EDGE CONNECTOR HAVING THE SAME

BACKGROUND OF THE INVENTION

1. Field of the Invention

The present invention generally relates to an ejector of a card edge connector.

2. The Prior Art

A card edge connector connects a daughter circuit board to a mother circuit board. Examples of card edge connectors include a dual in-line memory module (DIMM) connector and ram bus in-line memory module (RIMM) connector. The card edge connector usually comprises an insulative housing defining a central slot for receiving the daughter board. Conductive contacts are retained in the housing and soldered to the mother board. The contacts electrically engage with the daughter board when the daughter board is inserted into the slot thereby establishing electrical connection between the mother board and daughter board.

An ejection mechanism comprising two ejectors pivotally retained in spaced guide walls and formed at opposite ends of the housing facilitates removal of the daughter board from the connector without physically damaging the daughter board. Each ejector forms projections on opposite surfaces thereof for releasably engaging with recesses defined in the guide walls of the housing thereby retaining the ejector at a secured position where the ejector engages with and retains the daughter board in the slot of the housing. The engagement is achieved by means of resilient deformation of the ejector and the guide walls.

To facilitate engagement between the projections of the ejector and the recesses of the guide walls, a cavity is usually defined in the ejector between the projections thereby rendering the ejector more resilient for facilitating deformation thereof. Examples of such an ejector are disclosed in U.S. Pat. Nos. 5,634,803 and 5,746,614.

FIG. 4 of the attached drawings shows a conventional card edge connector 110 employing an ejector 122. The conventional card edge connector 110 comprises an insulative housing 112 defining a central slot 114 for receiving a daughter board (not shown). Two spaced guide walls 116 are formed on each longitudinal end of the housing 112. Each of the guide walls 116 defines a pivot hole 118 for receiving a pivot pin 120 of the ejector 122 thereby allowing the ejector 122 to be movable with respect to the guide walls 116 between a secured position and a released position. Projections 124 are formed on opposite side surfaces 126 of the ejector 122 for releasably engaging with recesses 128 defined in the guide walls 116 thereby retaining the ejector 122 at the secured position.

A cavity 130 is formed in the ejector 122 between the projections 124 for enhancing the resiliency of the ejector 122 thereby facilitating engagement between the projections 124 and the recesses 128 of the guide walls 116. However, the cavity 130 weakens the mechanical strength of the ejector 122 thereby causing breakage or substantial deformation of the ejector 122 during operation.

Thus, an ejector for a card edge connector which overcomes the mechanical strength problem is required.

SUMMARY OF THE INVENTION

Accordingly, an object of the present invention is to provide an ejector of a card edge connector comprising a reinforced rib arranged in a cavity defined in the ejector for reinforcing the ejector while maintaining the resiliency provided by the cavity.

To achieve the above object, an ejector of a card edge connector in accordance with the present invention comprises a body received between two spaced guide walls of an end block of a housing of the connector. Two slits are defined in the body thereby forming two outside walls and a central wall. Each outside wall has a projection for releasably engaging with a recess defined in the corresponding guide wall. The slits provide the outside walls with resiliency for facilitating engagement between the projections thereof and the recesses of the corresponding guide walls, while the internal wall provides the ejector with rigidity during engagement between the projections and the recesses.

BRIEF DESCRIPTION OF THE DRAWINGS

The present invention will be apparent to those skilled in the art by reading the following description of a preferred embodiment thereof with reference to the accompanying drawings, in which.

DETAILED DESCRIPTION OF THE PREFERRED EMBODIMENT

Figure 1:
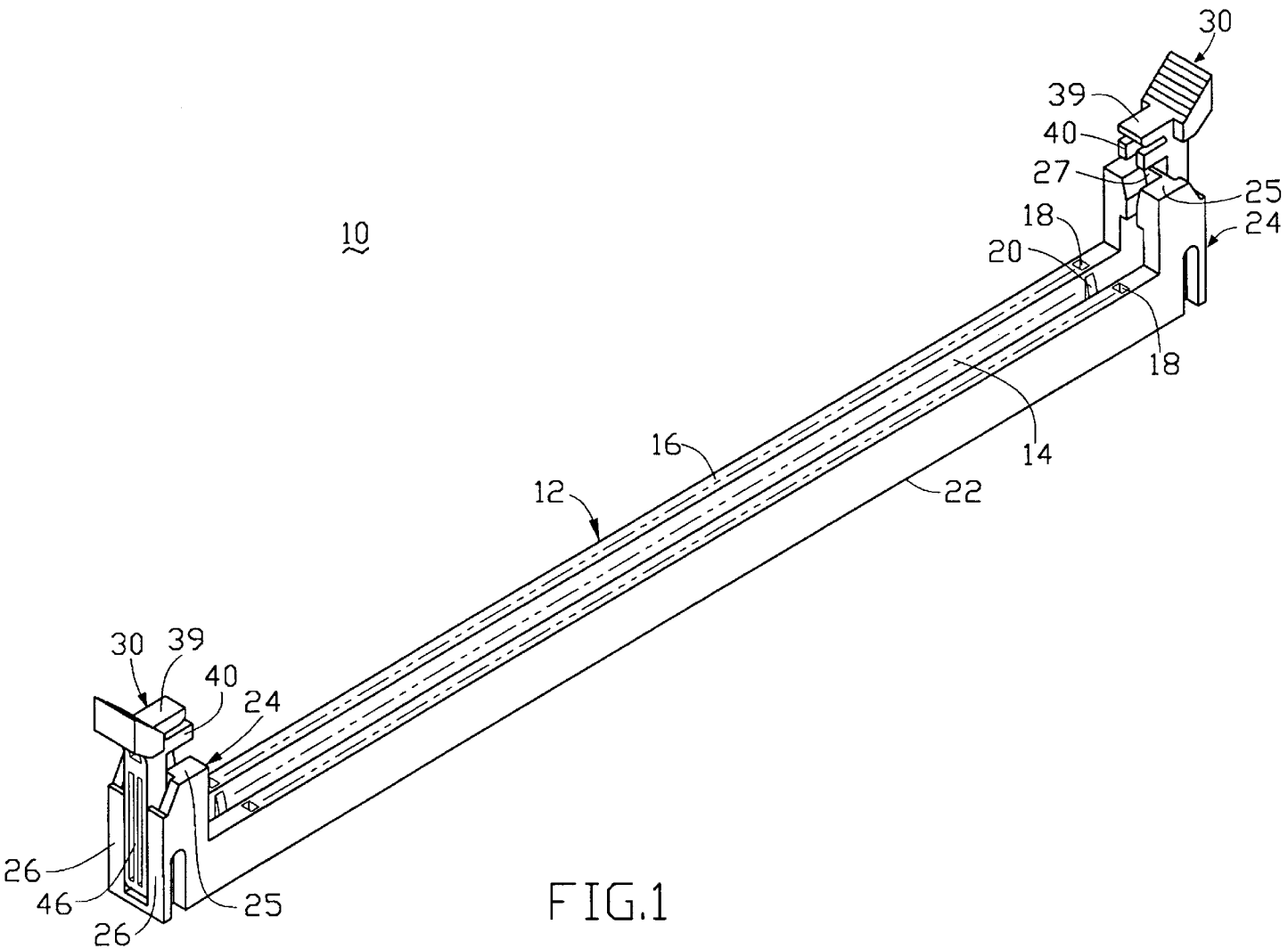
FIG. 1 is a perspective view of a card edge connector incorporating ejectors constructed in accordance with the present invention.
Figure 2:
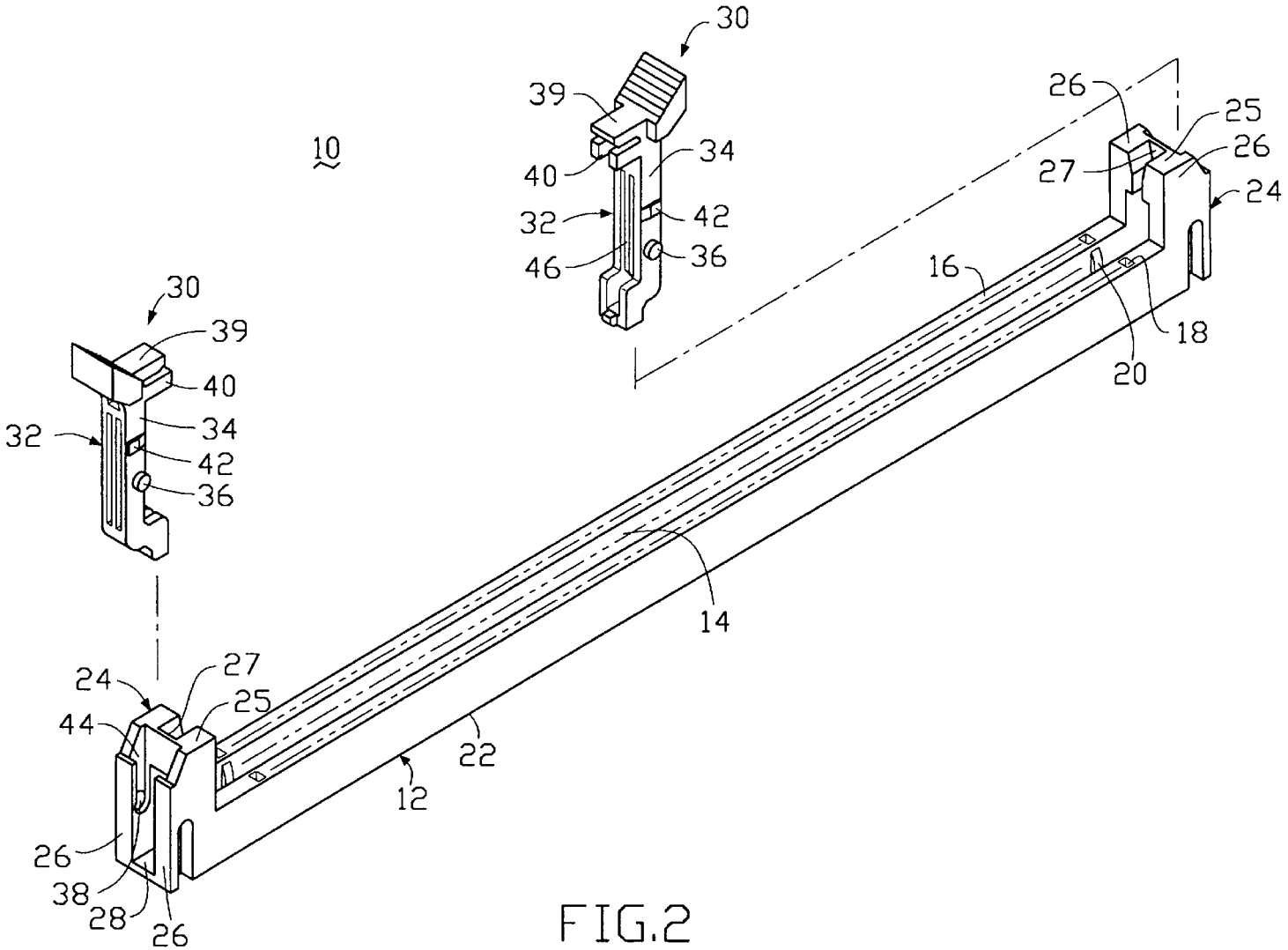
FIG. 2 is an exploded view of FIG. 1.

Referring to the drawings and in particular to FIGS. 1 and 2, an electrical connector 10 comprises an elongate insulative housing 12 defining a slot 14 in a top face 16 thereof and substantially coextensive therewith for receiving a daughter circuit board (not shown) therein. A plurality of passageways 18 are defined in the housing 12 on two sides of the slot 14 for receiving and retaining conductive contacts 20 therein. The contacts 20 extend beyond a bottom face 22 of the housing 12 for being soldered to a mother circuit board (not shown) and partially extend into the slot 14 for engaging with the daughter board thereby establishing electrical connection between the daughter board and the mother board.

Two end blocks 24 are formed on opposite ends of the housing 12. Each end block 24 comprises two spaced guide walls 26 defining a channel 28 therebetween. An ejector 30 comprises a body 32 movably received in the channel 28 of each end block 24. The body 32 has opposite side walls 34 each having a pin 36 formed thereon for being pivotally received in a corresponding hole 38 defined in an inside surface of each guide wall 26 of the end block 24 thereby allowing the ejector 30 to be movable between a secured position and a released position. At the secured position, as shown in FIG. 1, a board retaining tab 39 of the ejector 30 engages with and thus retains the daughter board in the slot 14. At the released position, the board retaining tab 39 is disengaged from the daughter board for releasing the daughter board from the connector 10. Each ejector 30 has a projection 42 formed on each of the side walls 34 thereof for releasably engaging with a recess 44 defined in the inside surface of the corresponding guide wall 26 to retain the ejector 30 at the secured position. A pair of clipping fingers 40 are positioned above the top surface 25 of the end block

24 while below the retaining tab 39 to cooperate with the guide walls 26 for restraining the lateral movement of the inserted daughter board in the housing 12 wherein the restraint of the daughter board along the lengthwise direction is provided by the reinforcement wall 27 between the corresponding pair of guide walls 26.

Figure 3:
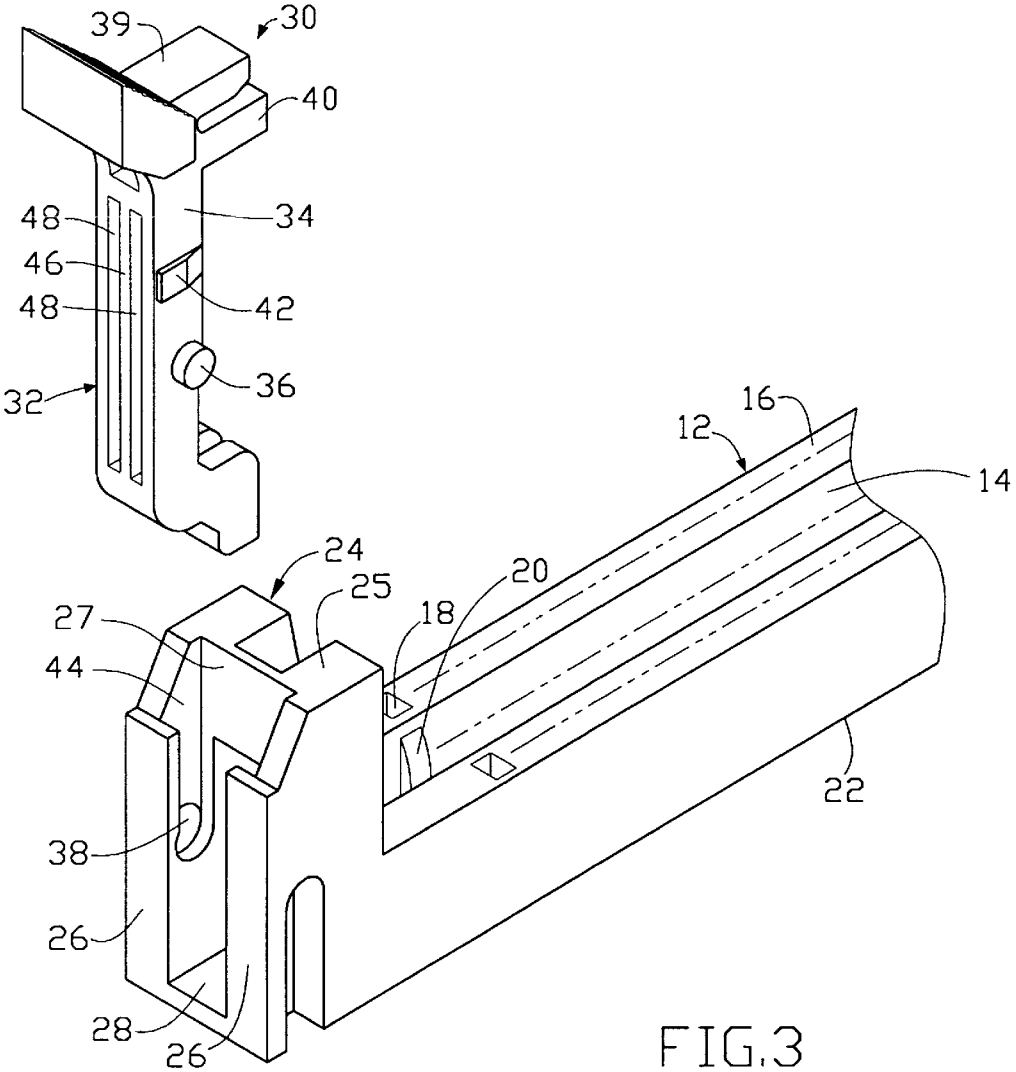
FIG. 3 is an enlarged view of a portion of FIG. 2 clearly showing the ejector of the present invention.
Figure 4:
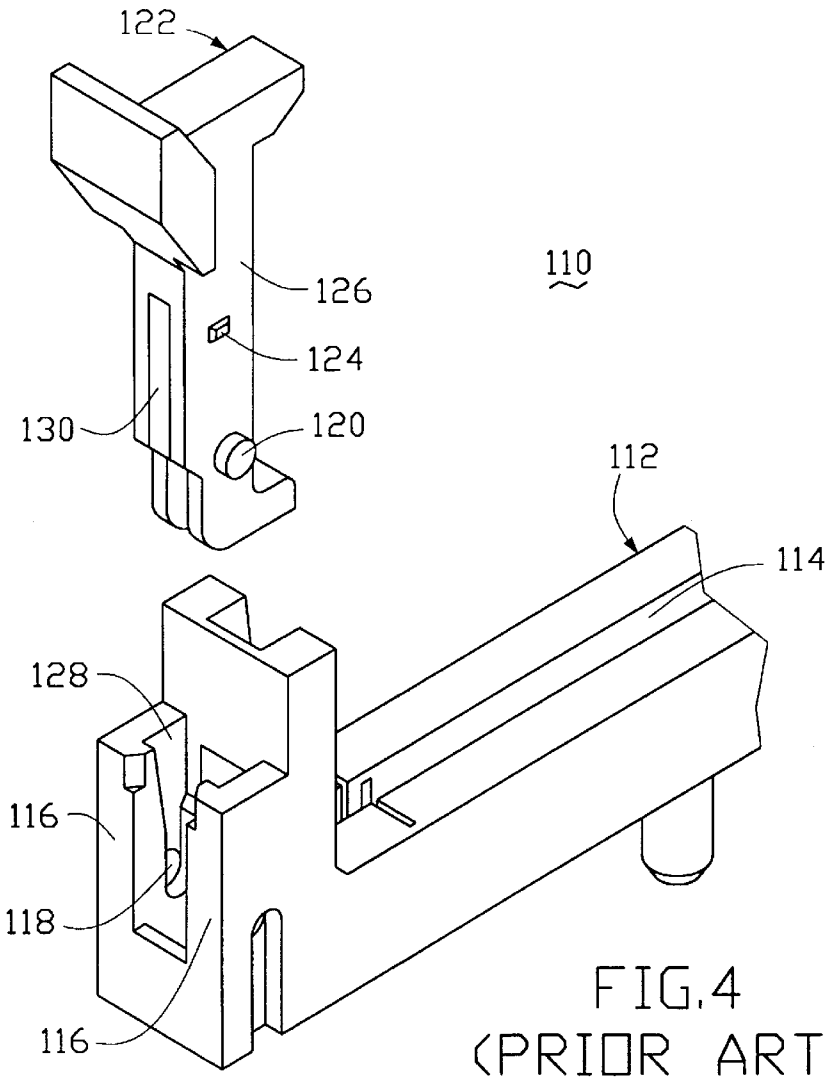
FIG. 4 (PRIOR ART)
FIG. 4 is an exploded view of a portion of a card edge connector incorporating a conventional ejector.

Also referring to FIG. 3, the body 32 of the ejector 30 comprises an internal, reinforcing wall 46 formed between the two side walls 34 thereby defining two slits 48 with the side walls 34. The slits 48 provide the side walls 34 with sufficient resiliency for facilitating engagement between the projections 42 and the recesses 44 of the guide walls 26 of the end block 24, while the reinforcing wall 46 provides the ejector 30 with sufficient rigidity during operation.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An ejector for an electrical connector comprising an elongate housing receiving and retaining conductive contacts and forming two end blocks on opposite ends thereof, each end block comprising two spaced guide walls, the ejector comprising a body received between the guide walls, two slits being defined in the body thereby forming two outside walls and an internal wall between the outside walls, each outside wall forming a projection for releasably engaging with a recess defined in the corresponding guide wall of the end block, wherein the slits provide the outside walls with resiliency for facilitating engagement between the projections thereof and the recesses of the corresponding guide walls while the internal wall provides the ejector with rigidity during engagement between the projections and the recesses.

2. An electrical connector comprising:

an elongated housing defining a central slot with a plurality of contacts by two sides;

a pair of end blocks positioned at two opposite ends of the housing;

each of said end blocks including at least a pair of guide walls;

an ejector disposed in each of said end block; and said ejector including a body with two opposite outside walls and an internal wall therebetween, said outside walls and said internal wall extending along a lengthwise direction of the body; wherein the outside walls are resilient for facilitating rotation of the ejector with regard to the housing while the internal wall is rigid for assuring strength of the ejector during operation.

3. The connector as described in claim 2, wherein said ejector includes a retaining tab spaced from a top surface of the corresponding end block and a pair of clipping fingers cooperating with the guide walls for restraining a lateral movement of a daughter board inserted within the housing.

4. The connector as described in claim 2, wherein a slit is positioned between the outside wall and the internal wall.

* * * * *